US008689669B2

(12) United States Patent
Rönn et al.

(10) Patent No.: US 8,689,669 B2
(45) Date of Patent: Apr. 8, 2014

(54) METHOD OF PRODUCING WARHEADS CONTAINING EXPLOSIVES

(75) Inventors: Torsten Rönn, Karlskoga (SE); Hans-Gunnar Larsson, Västerås (SE)

(73) Assignee: Bofors Defence AB, Karlskoga (SE)

( * ) Notice: Subject to any disclaimer, the term of this patent is extended or adjusted under 35 U.S.C. 154(b) by 1273 days.

(21) Appl. No.: 10/429,191

(22) Filed: Apr. 30, 2003

(65) Prior Publication Data

US 2014/0020590 A1 Jan. 23, 2014

(51) Int. Cl.
*B21K 21/06* (2006.01)

(52) U.S. Cl.
USPC ..... 86/53; 102/496

(58) Field of Classification Search
USPC ..... 86/53; 102/494, 495, 496; 419/6, 8
See application file for complete search history.

(56) References Cited

U.S. PATENT DOCUMENTS 2,568,126 A * 9/1951 Keeley ..... 156/298
3,815,504 A 6/1974 Tieben ..... 102/67
3,945,321 A * 3/1976 Mayer et al. ..... 102/496
4,032,335 A * 6/1977 Zapf et al. ..... 419/6
4,129,061 A 12/1978 Bedall et al. ..... 86/20
4,503,776 A 3/1985 Nussbaum et al. ..... 102/496
4,644,867 A 2/1987 Hellner et al. ..... 102/495
4,936,217 A * 6/1990 Hofmann et al. ..... 102/496
H1048 H * 5/1992 Wilson et al. ..... 102/496
6,080,358 A * 6/2000 Oba et al. ..... 419/5

* cited by examiner

*Primary Examiner* — Stephen M Johnson
(74) *Attorney, Agent, or Firm* — Jacobson Holman PLLC

(57) ABSTRACT

The present invention is directed to a method for production preformed fabrication casing or associated parts intended to generate fragments initiated by the explosive of contained warhead charges. Molded parts having fragmentation bodies (4, 21, 34) embedded therein are produced by a two-stage powder compaction method followed by sintering together the compacted powder metal. The method described in the present invention defines how in an initial stage the fragmentation bodies (4, 21, 34) are fixed in position using a fixture (2) after which the bodies are covered with powder metal that is then compacted until the powder forms a single molded part (2) after which the fixture is replaced with a secondary quantity of powder that is also compacted to form a self-supporting unit (12) together with the first quantity of powder.

11 Claims, 5 Drawing Sheets

METHOD OF PRODUCING WARHEADS CONTAINING EXPLOSIVES

BACKGROUND OF THE INVENTION

The present invention relates to a method of producing a sintered fragmentation casing for explosives-charged warheads by applying powder metal technology. The present invention also includes various configurations of fragmentation casings produced in accordance with the said technology. A special feature of the fragmentation casings as claimed in the present invention is that their powder metal technology produced supporting main section or moulded part contains a large quantity of fragment bodies embedded at predetermined locations and distributed differently, and produced in a harder and heavier material than that used for the main mass of the moulded part. In this context the said fragment bodies are preferably comprised of heavy metal balls.

By powder metal technology is meant here that the single-piece supporting main section or moulded part is completely or partially formed by a suitable powder metal that is compressed until it assumes the desired form and is sintered together to form a homogenous metal.

Two different methods of producing homogenous metal bodies using powder metallurgy technology are well known. One of the said methods is designated in everyday language as HIP-ing or hot isostatic pressing which means that the basic powder material being used is isostatic compressed at the same time as it is sintered to form a homogenous metal. The other method is designated SIP-ing which means that the powder material is first cold isostatic compressed until the desired density is achieved, after which the compressed powder granules are sintered in a separate process until a homogenous metal is formed.

Both of these general methods can be utilised within the basic concept of the present invention.

By the designation heavy metal is meant here primarily high density Wolfram alloys. Depleted uranium has also been used in similar circumstances but it is still regarded with doubts regarding its effect on health during handling prior to use as well as any radioactive fallout after use.

When combating airborne targets such as aircraft and various types of missiles using barrel-fired projectiles or own missiles, as a rule it cannot be counted on that a direct hit on the target will be achieved and instead a near-miss must suffice and that the explosive charge-loaded warhead can be detonated as close to the target as possible. For this to be enabled the said warhead must be provided with a proximity fuze or equivalent that controls its detonation until the optimal point in time for combating the target with pressure and fragments. In most cases the greatest effect in the target from the said type of near-miss is achieved when the explosive charge is enclosed in a fragmentation jacket comprising a large number of pre-formed fragment bodies. Heavy metal bodies are now assumed to be the best technical and most economic fragment bodies as they have a high level of density and when they are enclosed in a fragmentation jacket they also create large quantities of fragments. The said heavy metal balls that are projected at high velocity by the detonation of the explosive generate good penetration even in semi-hard targets and in addition their size and consequently their dispersion pattern are predetermined. On the other hand it is more difficult to determine exactly how an originally homogenous fragmentation jacket for an explosive charged projectile will disintegrate when subjected to the detonation of an explosive charge and consequently the fragment dispersion pattern thus formed will be difficult to determine and partially at random. Therefore the intention was to provide air defense explosive-charged projectiles with a fragmentation jacket containing a large quantity of heavy metal balls that when the explosive is detonated it will eject a swarm of the said heavy metal balls in the direction of the target. However, to produce such a fragmentation jacket is not the easiest of tasks because the object is to have the greatest possible number of heavy metal balls penetrate the target and therefore the form of the fragmentation jacket is a critical factor in this context. Even in relatively simple forms this type of fragmentation jacket is relatively problematic to manufacture using the technologies currently available.

In this context U.S. Pat. No. 3,815,504 describes a method of producing fragmentation jackets for use in artillery shells where heavy metal balls are filled in between an inner and an outer tubular casings until the space between them is completely filled after which the inner tubular casing is subjected to high inner pressure either via a slightly conical "dolly" device or an inner detonation which secures the heavy metal balls by means of deformation of the inner tubular casing.

The said method of producing fragmentation jackets however, has the disadvantage of leaving a gap between the heavy metal balls which at an early stage of the detonation phase of the explosive contained in the complete shell causes pressure leakage between the said heavy metal balls thus exerting a lower velocity on them than would have been the case had they been completely encased by a moulded part.

U.S. Pat. No. 4,503,776 further describes a fragmentation jacket comprising projectile-formed fragment bodies that are provided with a rear free opening that is used partly to fix the said fragment bodies in position in a fixture while the said fragment bodies are moulded in a base material, and partly for filling with incendiary material or equivalent after the moulding process is completed and the fixture has been removed. The moulding material used is cast iron and the said fixture can be of a ceramic material that can be either left in place or be removed when the moulding base material has set. The most immediate problem with this method would appear primarily to be the risk of porosity in the moulded material.

Finally, U.S. Pat. No. 4,129,061 describes a prefragmented shell having an outer casing produced using powder metallurgy technology. In this variant a compact layer of heavy metal balls is arranged around a single-piece body and thereafter the said compact layer of heavy metal balls is covered with powder metal that is then compacted and sintered together after which the centre body bored out to receive the explosive charge and the sintered powder jacket is finish-machined to the intended shape of the shell. However, the said patent does not disclose how the heavy metal balls are retained in their positions until the powder metal is introduced and compacted to form a single unit. Moreover, the said method requires considerable subsequent work and creates the risk of irregular powder density in critical areas.

Several years ago we made several attempts to produce shells provided with a prefragmented casing by applying powder metallurgy technology but the results were not completely satisfactory. Even though current conventional powder metallurgy technology is used to produce a large variety of different products there is a particular problem involved when producing prefragmented casings, namely the said casings shall contain such a large quantity of separately produced heavy metal balls from the very start. That is to say it is the material between the heavy metal balls that holds them together and gives the prefragmented casing its outer form that is to be created by powder metallurgy technology and inside the said single-unit casing or moulded part the heavy metal balls shall be embedded.

This is to say that a prefragmented shell casing containing embedded heavy metal balls comprises two different materials of which the heavy metal balls are already produced completely prior to formation of the single-unit casing and compaction by the powder metal that is then sintered together to form a single homogenous unit. The greatest difficulties with manufacturing prefragmented shell casings by applying powder metallurgy technology is that the materials to be included will have completely coefficients of expansion while the sintering phase involves the entire pre-formed body must be heated to the sintering temperature of the powder component. In previous attempts to produce prefragmented casings by applying powder metallurgy technology the frequency of shrinkage cracks in the casings was so high that as far as we are aware they never appeared on the market.

Previously tested techniques in this field are described in Swedish Patent SE 450294 (=U.S. Pat. No. 4,644,867) represented in the form of powder metallurgy technology produced prefragmented shells the casings of which were produced by means of completely pre-formed heavy metal balls embedded in powder metal that are then subjected to high temperature and high pressure from all directions to form a tightly compacted casing. Even if this patent, which is our own, does not state clearly how we were able to retain the heavy metal balls in their correct positions in the metal powder jacket, at that period of time we utilised a technique where we first attached the pre-formed heavy metal balls to a single-piece prefragmented casing which we then surrounded with powder steel which was then compacted under high pressure and sintered together to form a single uniform material. The problem using this technique was that the heavy metal balls formed a single inter-connected layer having completely different shrinkage properties than the surrounding powder metal technology produced material. Consequently, the frequency of cracks in the powder metal technology produced fragmentation jacket was too high for the production method to be utilised for mass production.

Unless we are very much mistaken the inventors responsible for U.S. Pat. No. 4,129,061 must have experienced a similar problem only more extensive as in the sintering phase their product contained compacted powder metal, a fragmentation jacket comprised of tightly packed heavy metal balls and an inner "dolly" that had a very large volume compared with the rest of the material.

SUMMARY OF THE INVENTION

The present invention now relates to an improved powder metallurgic method of producing fragmentation jackets or parts thereof containing large quantities of heavy metal balls distributed in the jacket in accordance with a predetermined pattern and intended for use in explosives-charged warheads. The present invention also includes a prefragmented casing produced in accordance with the said method.

A particular advantage gained from utilisation of the method as described in the present invention is that it enables production of fragmentation jackets having varied fragment dimensions contained within different sections of a more or less cylindrical prefragmented casing. This is to say that the said method would for example enable a rotating projectile moving along trajectory in the direction of the target and provided with a fragmentation jacket to detonate the built-in explosive warhead charge at a specific rotational position where the fragment bodies best suited for the target type in question are expelled towards the target. The advantage with this type of projectile containing differently dimensioned fragment bodies contained within different sections of its own exterior periphery is therefore that first when very near the target it can be decided which fragmentation bodies would have the best effect in the target. In this context the specific need to always be aware of the immediate roll position of the projectile does not present any difficulty for current sensor technology.

A further method for utilisation of this type of fragmentation casing having various sections containing differently dimensioned or differing in some other way fragment bodies is application in fin-stabilised, roll-stable, flying projectiles where the type of fragmentation casing to be used can be selected for use against an expected target.

A further characteristic feature of the present invention is that it presents a production method that makes possible the manufacture of fragmentation jackets in which the heavy metal balls are located completely free from contact with each other embedded in a powder metal technology produced main section or moulded part which in turn constitutes the exterior form of the fragmentation jacket and enables it to be further machined. As the heavy metal balls utilised as fragment bodies are located free from contact with each other in the powder metal technology produced moulded part, the said moulded part material can move during the sintering and cooling of the metal independently of the material in the heavy metal balls thus preventing the formation of cracks due to shrinkage in the homogenous metal after sintering of the powder metal.

When applying the production method characteristic for the present invention the desired location of the heavy metal balls completely free from contact with each other embedded in the yet to be sintered powder metal casing is defined first with the aid of a fixture after which the said heavy metal balls are surrounded with a suitable powder metal, preferably a powder steel that is then compacted and sintered to form a homogenous single-piece moulded part which if necessary can then be conventionally machined to the desired form and measurement accuracy. By utilising the method as defined in the present invention the occurrence of heat cracks in the material created during and in conjunction with sintering the powder metal and subsequent setting is avoided.

Production-wise, the method as claimed in the present invention can be divided in to three stages the first of which involves defining the desired location of the heavy metal balls relative to each other with the use of a fixture. The said fixture can be formed in several different ways but one variant is that its base is provided with the same number of guide cavities as there are fragment bodies or parts thereof as there will be when complete. The said guide cavities or guide means shall in this way define the locations of the fragment bodies relative to each other even though they shall only contact a small part of each fragment body when they are placed in their intended location in the supporting main section or moulded part. In this way a large part of the exterior surface of each fragment body remains free from contact and preferably more than half of its volume is left free to be surrounded by the metal powder used to produce the said moulded part during its subsequent production stage. In other words the said metal powder shall be added in sufficient quantity as to completely fill the space between the fixture and the heavy metal balls as well as between and over the said heavy metal balls to a predetermined level over the base of the fixture after which this initial layer of powder metal is compacted to form a single homogenous unit after which the fixture is then removed. While in the fixture the powder metal can be compacted mechanically, isostatically or semi-isostatically and in this way a further development of the present invention can be utilised to advantage by using a relatively thick rubber mat as a pressure equaliser in order to ensure a uniform distribution of compression on the entire volume of the powder metal.

Any tendency of the fragment bodies to leave their intended locations in the fixture prematurely can be prevented by application of an adhesive that does not have a greater adhesion strength than would prevent subsequent removal of the fixture. Similarly, adhesion of the powder metal to the fragment bodies can be improved with a for this purpose suitable substance. The entire process is based it being possible to remove the fixture without disturbing the fragment bodies from their intended locations in the compressed metal powder mass.

After this first powder metal compression stage there is now access to a single-piece moulded part in which the locations of the heavy metal balls are clearly fixed and where the said heavy metal balls are completely free from contact with each other inside the powder metal moulded part and where only that part of each heavy metal ball that has been in direct contact with the fixture protrudes from the first compressed powder metal moulded part. The next stage in the process as claimed in the present invention is to remove the said fixture and then to cover those parts of the heavy metal balls that previously were in direct contact with the fixture with a predetermined depth layer of powder metal mass after which it is also as previously described isostatically, semi-isostatically or mechanically compressed in a similar way to form a single-piece moulded part.

During this second powder metal compression it is advantageous to utilise a fixed surface to provide resistance to the previously compressed powder metal body. The second addition of powder metal/powder metal compression stage cal also be performed on individual or several previously moulded units produce during the first powder metal compression stage 1*f* during the second stage several units produced in accordance with the first stage as defined in this present invention are to be progressed then it is this second compressed powder metal mass that will unite the various units up to and including the sintering stage. The result from the said second powder metal compression will be a semi-fabricated powder metal containing embedded fragment bodies in the form of heavy metal bodies at predetermined locations The said semi-fabricated powder metal that can withstand a certain amount of handling is then subjected to sintering which converts the extremely compressed powder metal to a homogenous moulded metal part within which the fragment bodies in the form of heavy metal balls lie embedded at their predetermined distance from each other. After completion of the sintering process the prefragmented casing as defined in the present invention is machined to the desired inner and outer forms by applying normal conventional metal machining methods. The of powder metal used in the method as defined in the present invention is not dealt with in detail as the choice of the said powder metal is based on conventional powder metallurgical knowledge. With regard to the method of compacting the powder metal used in both the powder metal compression stages as defined in the present invention it is the case that as previously stated it can be performed isostatically, semi-isostatically and/or more or less mechanically and as regards the final sintering it can be performed as a separate final process stage or be included in a hot isostatic combined compression and sintering stage.

Within the framework of the above basic principles the method described in the present invention can be varied in its practical implementation in that the simplest variant is the one that involves producing fragmentation casing or parts thereof while utilising a more or less flat or slightly domed geometry and can be produced by the vertical compression of primarily horizontal layers of powder metal.

A characteristic feature of the present invention is that its basic principle enables several variants of prefragmented casing to be produced. For example it is possible to directly fabricate prefragmented tubular casing but this requires either a considerably more complex fixture or some other aid that can hold the heavy metal balls in position until the powder metal has attained a sufficiently high degree of compaction.

As a simple guideline it can be said that it is difficult hold the heavy metal balls in position using only gravitation and simple guide cavities during the first addition of powder metal/powder metal compression stage if the surface of the moulded part is inclined more than 30° relative to the horizontal surface.

As a further aid for holding the heavy metal balls in position on a surface with an excessive inclination for example is an adhesive that has sufficient adhesion properties to hold the heavy metal balls in position during the first stage while allowing the fixture to be removed prior to stage two. A further variant would be to fix the heavy metal balls in their original locations in the fixture using a hot adhesive that loses its adhesion after limited heating.

In accordance with a further variant of the present invention tubular or spherical prefragmented casing or in some other complex form can however be produced via several bulged, convex or concave or some other integral form horizontally placed parts to be united in conjunction with the second addition of powder metal/powder metal compression stage, whereas until now fabrication of the parts was performed individually. The limiting factor for the simplest variant of the present invention is when the heavy metal balls will no longer remain in their intended locations on the more or less horizontally arranged fixture. As already pointed out more than half of each heavy metal ball must protrude from the fixture so that the powder metal affixes their location in all directions thus defining their completely free from contact relative to each other location in the compacted powder material. For this first variant the fixture in general can take the form of a relatively simple hole-patterned disc or a disc with a number of guide cavities for the heavy metal balls where a ball is placed in each guide cavity.

In a further variant of the present invention the fixture is formed in such a way that the heavy metal balls can be held in their guide holes or cavities by suction. The suction force that holds the heavy metal balls in place in accordance with this variant of the present invention must be sufficient to overcome the force of gravity. When producing e.g., heavy metal ball tubular fragmentation bodies we start with a fixture cylinder having the desired form and provided with a large number of holes drilled through the wall of the said cylinder where each hole is in contact with a suction source which draws a heavy metal ball to itself and to each of the openings of the said holes which means that the said cylinder can be arranged vertically and on the side to which the heavy metal balls have been suctioned against be surrounded by or internally supplemented with an opposing wall preferably made from a relatively stiff but flexible material such as stiff rubber matting after which the space between this said new wall and the fixture is filled with powder metal around and over the heavy metal balls after which the said powder metal is compressed so that the said balls are embedded in the layer of powder metal. In this context compression of the powder metal is preferably performed semi-isostatically after which the said flexible material wall via which the said compression of the powder metal was performed in this first stage is removed and replaced with a fixed retainer, while the fixture is replaced with the same type of stiff but flexible material as was used in the first production stage and at a distance from the powder surface that was compressed also during the said first stage, that provides sufficient space for the remaining required quantity of powder metal that is added and then compressed so that even the remaining parts of the fragment bodies are covered completely after which the powder metal body so created is ready for sintering and possible subsequent final machining by conventional means.

The method described above can also be modified so that the first stage is performed primarily horizontally after which similar horizontally produced stage one modules or powder fragment body parts are combined to form a single-piece unit surrounded by powder that is compressed to form a second layer of powder the holds the resulting body together until the sintering process is completed.

BRIEF DESCRIPTION OF THE DRAWINGS

The present invention is defined in the subsequent Patent Claims, and shall now be described in further detail with reference to the appended figures.

In these figures:

FIG. 4 shows a cross-section projection through a tubular-formed prefragmented casing comprised of fragmentation sections as shown FIGS. 1-3 while

FIG. 9 shows a cross-section projection through a tubular-formed prefragmented casing at a later stage in its production while FIG. 10 shows a cross-section projection of a specially-formed prefragmented casing at a later stage in its production while

DETAILED DESCRIPTION OF THE INVENTION

Figure 2:
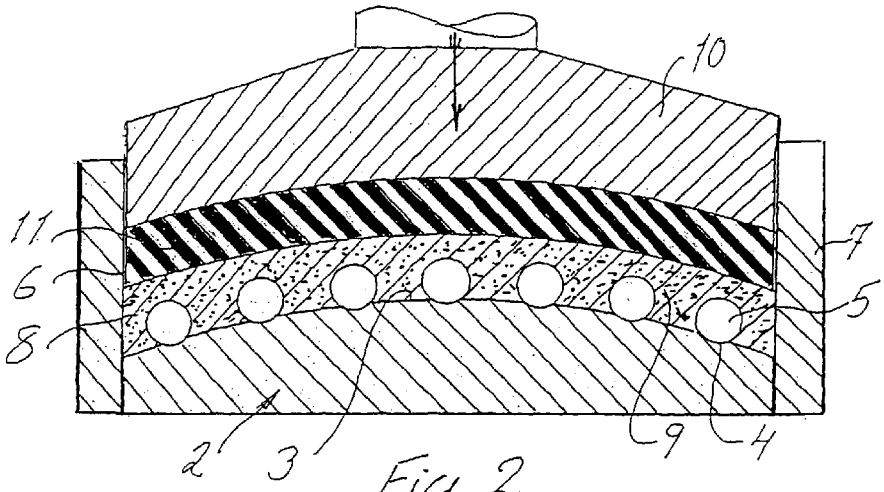
FIG. 2 shows a larger-scale cross-section projection of the prefragmented shell casing shown in FIG. 1 during an early stage in its production
Figure 3:
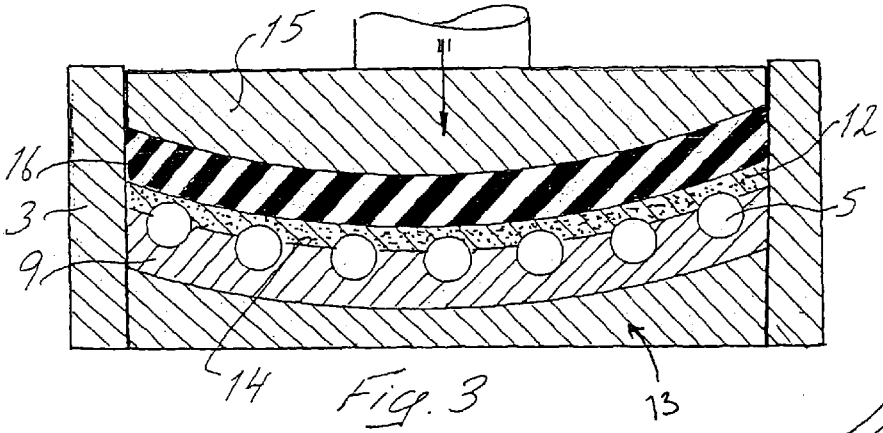
FIG. 3 shows the same projection as shown in FIG. 2 but at a later stage in its production
Figure 1:
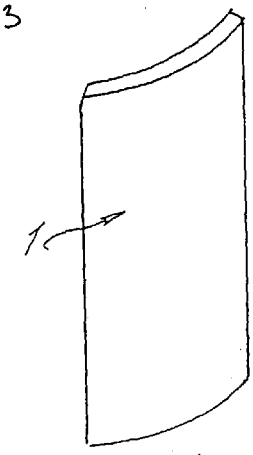
FIG. 1 shows an oblique small-scale projection of a section of prefragmented shell casing

In order to produce the sector of prefragmented shell casing 1 shown in FIG. 1 a fixture 2 as shown in FIG. 2 is required and it shall have a bulged upper surface 3 provided with a number of guide cavities 4. The said fixture can as shown in the Figure have an upper surface provided with guide cavities and be flat, concave, convex or be a combination of these forms. The upper surface of the fixture shown in FIG. 1 is depicted as convex. In each one of the fixture 2 upper surface 3 guide cavities 4 a heavy metal ball has been located. Each one of the guide cavities 4 is so deep and so adapted to the diameter of the balls 5 that the said balls lie still in the said cavities which in turn are not deeper than they allow less than half of the ball 5 to enter down in to the cavity. The balls shown FIGS. 2 and 3 are depicted equally large but they may well be dimensioned differently with their individual guide cavities dimensioned to suit the applicable individual ball intended for it. The previously mentioned fixture 2 is also provided with side-walls 6 and 7 and end-walls not shown in the figures. With its base 3 and each of its end and side-walls the fixture 2 features a limited space 8 inside which the cavities and balls are positioned. The said space is then filled with a for this purpose suited powder metal 9, e.g., a steel powder, that is leveled-off to form an even layer of the predetermined thickness after which as indicated in FIG. 2 the powder is compacted using a compaction "dolly" 10 to such an extent that the powder body 9 with embedded heavy metal balls 5 so created support themselves and can be removed from the inner space 8 in the fixture 2. As a pressure compensating medium in the event of any irregularities in the powder layer 9 and to ensure uniform compaction of the powder even between the balls 5 thick rubber matting 11 between the powder layer 9 and the compaction "dolly is used". FIGS. 2 and 3 show that the balls 4 are located completely from contact with each other in the single piece moulded part at the same time as the different metal balls were completely fixed in the said moulded part already during the production stage shown in FIG. 2 as more than half of each ball is surrounded by and fixed in the powder moulded part 9 produced in this first stage.

After the so-produced powder body 9 is removed from the fixture 1 and possibly been machined the said powder body is turned over and given a second layer of powder 12 that will enclose those parts of the balls 5 that were located down in the guide cavities 4 in the fixture 2 during the initial production phase. The application and forming of this second layer of powder 12 is performed in a second fixture 13 to which the originally produced powder body has now been transferred. The said second fixture has in this case an oppositely bulged base 14 that is to say concave as the fixture 2 base 3 was convex during stage one. The second layer of powder is compacted in the fixture 13 using the compaction "dolly" 15 with the rubber matting 16 for pressure compensation. The final stage in the production of the intended powder metal casing as shown in FIG. 4 is to sinter together the required number of prefragmented casing sections at the same time as the powder material in each casing are sintered together to form a homogeneous metal.

Figure 9:
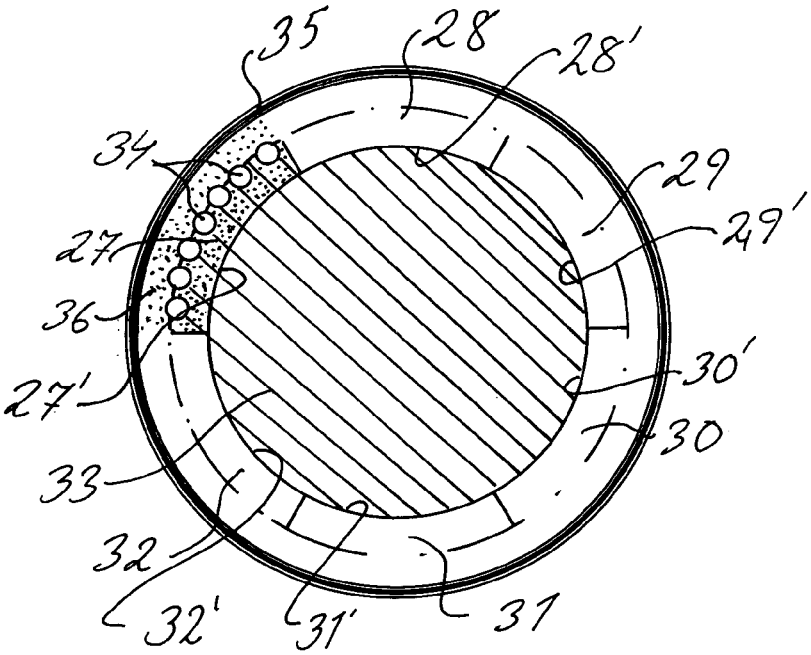
Figure 10:
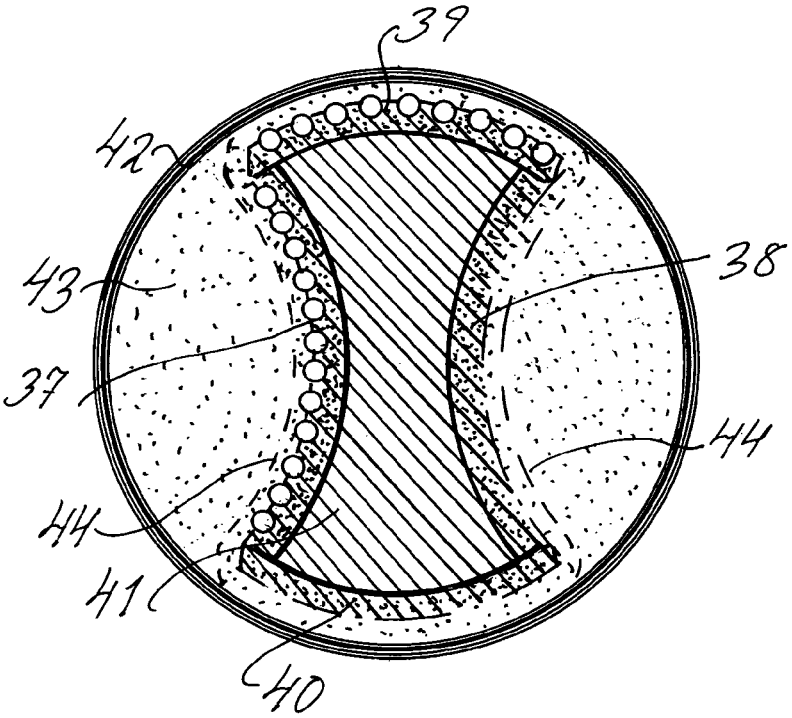

With the methods illustrated in FIGS. 2 and 3, the entire powder body for the prefragmented shell casing is completed prior to its possible combination with and sintering together with other completely finished powder bodies. With the said procedures the material strength of the completely finished and completely, sintered body is dependent on the sintering together of the joins between the powder bodies being perfectly satisfactory. FIGS. 9 and 10 show a somewhat different method where the emplacement of several powder bodies is performed already between the addition of and compression of the first and second layers of powder. Consequently, this variant creates a further completely coherent powder layer that in many cases can be advantageous.

Figure 4:
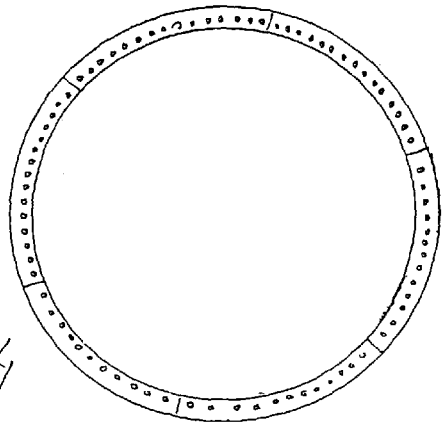

The cross-section shown in FIG. 4 shows the preformed fragmentation casing which has such a large diameter that it is not necessary to fill its entire volume with explosive. By utilising the centre space e.g., for installation of the guidance electronics present in a missile and then in turn to surround the said electronics with a layer of explosive and then finally surround the said layer of explosive with the said preformed fragmentation casing the missile is provided with a larger fragmentation volume than otherwise would have been the case.

FIGS. 5 to 8 show a variant as claimed in the present invention when it is desired to produce a cylindrical preformed fragmentation casing as a single unit. The preformed fragmentation casing does not necessarily require to have the cylindrical cross-section shown in the Figures but can be provided with any form of cross-section. The tubular body created during the process presented in FIGS. 5-8 is intended in combination with separately produced front and rear bodies to be transformed in to an artillery shell or some other form of warhead.

The equipment required to produce this variant of the present invention will be rather more complicated and consequently in order not to make the Figure confusing the details have only been drawn within one of three identical sector elements in each Figure.

Figure 5:
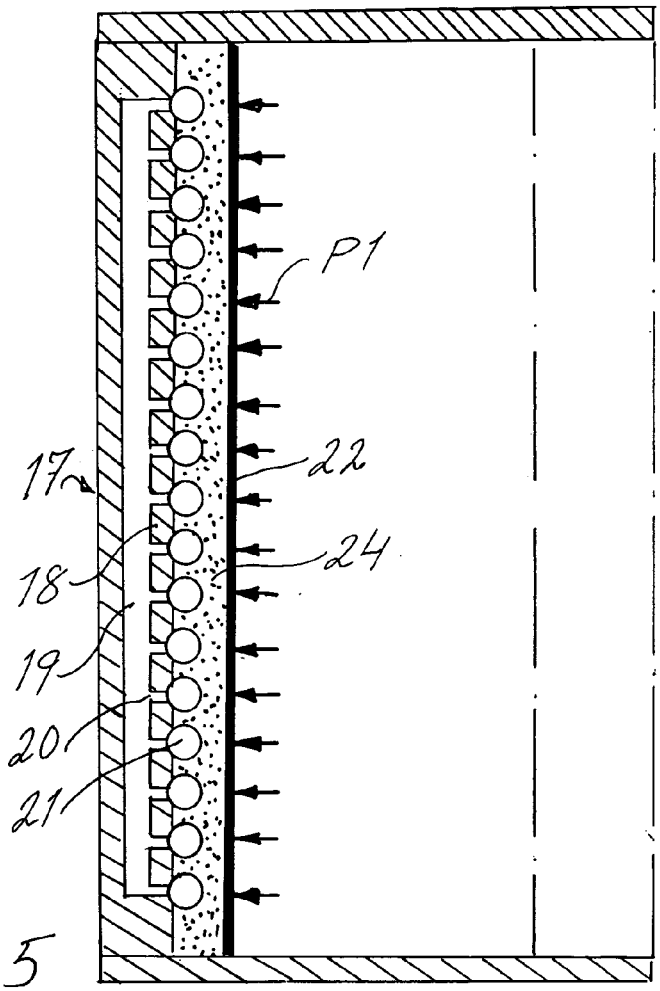
FIG. 5 shows a longitudinal projection through a tubular-formed prefragmented casing at an early stage in its production

In practice it is also opportune to prepare the production of one sector at a time each of which is represented by a fixture 18 of the type indicated in FIG. 5. In order to produce a complete, preformed, fragmentation casing of the type shown in FIGS. 5 and 6, three identical to each other and interconnectable fixtures of the said type are required. The quantity of said fixtures can be varied subject to the desired final form of the preformed fragmentation casing. Consequently, in order to produce preformed fragmentation casing as shown in FIG. 4 requires six sections of casing that can be arranged in the same fixture and then be joined together, while in accordance with FIG. 9 also here requires six sections of casing arranged in the same fixture, but the said sections of casing are joined together at an earlier stage than that shown in FIG. 4. For the variant shown in FIGS. 5-8 three fixtures are required while the variant shown in FIG. 10 can be produced with the aid of four powder casing parts located in two different fixtures.

Figure 6:
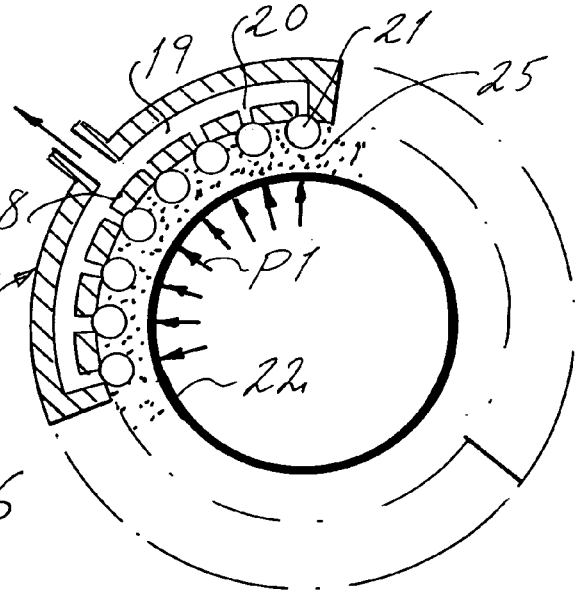
FIG. 6 shows the cross-section V-V shown in FIG. 5
Figure 7:
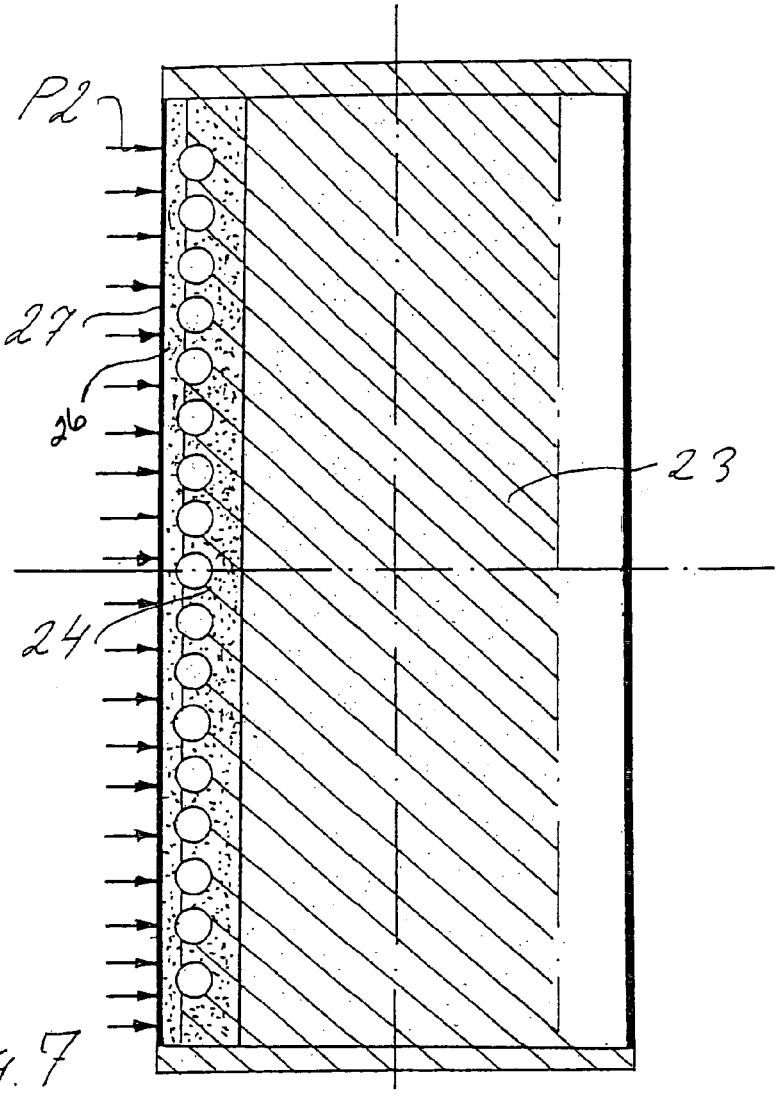
FIG. 7 shows the same prefragmented casing and projection as shown in FIG. 5 but at a later stage in its production
Figure 8:
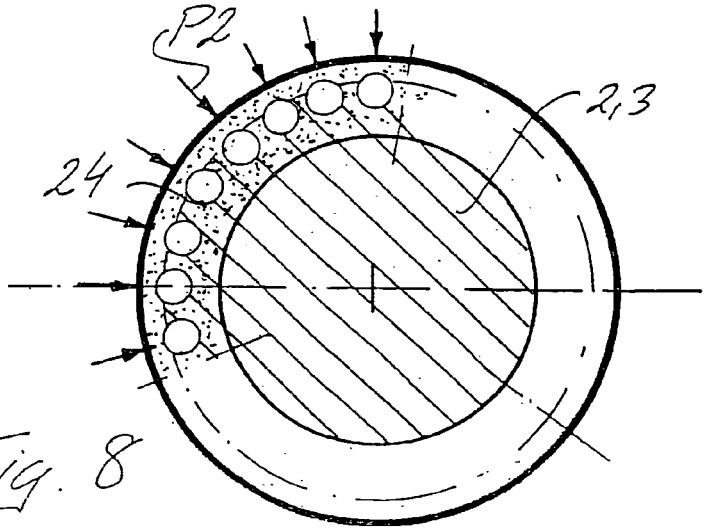
FIG. 8 shows the cross-section VII-VII shown in FIG. 7

Consequently, the fixture 17 as shown in FIGS. 5 and 6, which requires three components namely 17, 17' and 17" and of which only 17 has been drawn in all its detail, comprises a hole-patterned disc 18 that limits an inner chamber 19 which in turn is connected to a non-depicted vacuum. The hole-patterned disc 18 is provided with a quantity of through-holes 20 which replace the cavities 4 in the previously described fixture 2. In each of the said holes 20, a heavy metal ball 21 can be held in place by the vacuum generated in the chamber 19. On the inside of the balls 21, a tubular unit 22 is located. It comprises a stiff but flexible material e.g., rubber. The space between the fixture 17 i.e.; in reality its hole-patterned disc 18, and the tubular unit 22 as well as the spaces between the heavy metal balls is then filled with the required type and quantity of powder metal 25 after which an isostatic pressure as indicated by the arrows P1 is applied, to the inside of the tubular unit 22. As soon as the powder material has been compacted to form a tubular self-supporting unit, the fixtures 17, 17' and 17" are removed, after which the complete powder unit including its embedded heavy metal balls is surrounded by a second tubular unit 23 and the original powder body with its partly embedded heavy metal balls 21 shall be adapted to suit the quantity of powder 26 required to supplement the desired preformed fragmentation casing. The original first tubular unit is replaced at the same time with a fixed "dolly" or holding device 27. An isostatic compression pressure P2 is then applied against the outside surface of the second tubular unit 2*a*.

As soon as the powder layer is self-supporting the isostatic pressure P2, the tubular unit 23 and the "dolly" or holding device are removed, after which the now created powder body can be sintered to the desired material strength level. In this way a tubular casing is created and in which heavy metal balls 4 are sealed freely suspended relative to each other and the said tubular casing can then be machined by conventional means to the desired form and dimensions.

In the case of the variant shown in FIG. 9 for production of complete tubular preformed fragmentation casing is based on six sections of casing 27-32 produced in accordance with the method illustrated in FIG. 2. Producing the said sections of casing involves only the first powder compaction stage. Contrary to the procedure shown in FIG. 2 however, a fixture having a convex inside surface must be used. FIG. 9 shows only those sections of casing 27. The exterior forms of the other sections of casing are only indicated in the said Figure. The preformed sections of casing 27-32 with their concave powder inside surfaces 27'-32' are arranged edge-to-edge around a steel "dolly" or holding device 33. Outside the exterior convex surface of the powder sections of casing where their heavy metal balls protrude, one of the said tubular flexible but stiff exterior walls 35 is then arranged at a suitable distance that provides space for the required second quantity of powder after which the space between the inside of the said inner wall and the powder sections of casing 27-32 is filled with powder metal 36 of the same type indicated previously in the present invention and the powder is then compressed until it forms a self-supporting powder layer around the entire body by the application of semi-isostatic compaction. The outer wall 35 and the "dolly" 33 are then removed and the completed tubular powder body is sintered to become a homogenous metal that contains embedded preformed heavy metal fragmentation balls located free from contact with each other. After which the outer wall 35 and the "dolly" 33 are removed and the completed tubular powder body is then sintered to become a homogenous metal that contains embedded preformed heavy metal fragmentation balls located free from contact with each other. The advantage with this variant is that through-going porous sintered joins are avoided and at the same time the sections of casing 27-32 can be produced more or less horizontally which can be performed in simpler fixtures than those required for the method shown in FIGS. 5-8.

FIG. 10 shows production of a more unique form. In this variant of the present invention the basic material is exactly the same as shown in FIG. 9 a quantity of preformed sections of powder casing 37-40 where the sections of powder casing in their final form have a concave outer surface while the sections of powder casing 39 and 40 in their final form have a convex outer surface. The sections of powder casing are then mounted on a special-to purpose adapted "dolly" 41 all of which are surrounded by a flexible outer wall 42 and the space inside is filled with powder metal 43 which is then compacted isostatically from the outside of the outer wall 42. As soon as the powder metal 43 becomes self-supporting the outer wall 42 is removed and the powder metal 43 is then sintered to become a homogenous metal. The variant of the present invention shown in the said Figure includes large quantities of metal that must be machined off the exterior of the preformed sections of fragmentation casing 37 and 38 via conventional metal machining. The external form of the fragmentation body is indicated by the broken line 44. In some cases it may be desirable to retain the holding device or "dolly" in position during sintering of the powder metal in which case it is necessary to pay particular attention to the material in the holding device or "dolly" as it must have similar expansion/contraction characteristics as does the powder body that is to be sintered and because it is preferable that it can be utilised several times.

As also shown in the said Figure large quantities of powder metal are required outside the concave sections of casing 37 and 38 but parts of the said sections can be replaced with inserts in which case the said inserts should be provided with a pressure-equalising, plastic deformation intermediate wall located facing in towards the sections of the powder casing.

In accordance with the general method as now described in the context of FIG. 10 tubular single-unit fragmentation bodies having convex, concave, flat and joined sectional surfaces.

After completion of the sintering operation the completed fragmentation casing can be shaped to the intended form and dimensions by means of pressing or some other conventional metal forming process. The exterior of the fragmentation casing can for example be pressed to its specified final dimensions in a calibration device.

A further variant of the present invention is based on producing several fragmentation casing sections as described above but are joined together while still in the powder stage and in a third compaction stage are pressed to become a single unit after which the powder metal is sintered to become a homogenous metal.

This said variant facilitates production of fragmentation casings containing several layers of fragmentation bodies.

Figure 11:
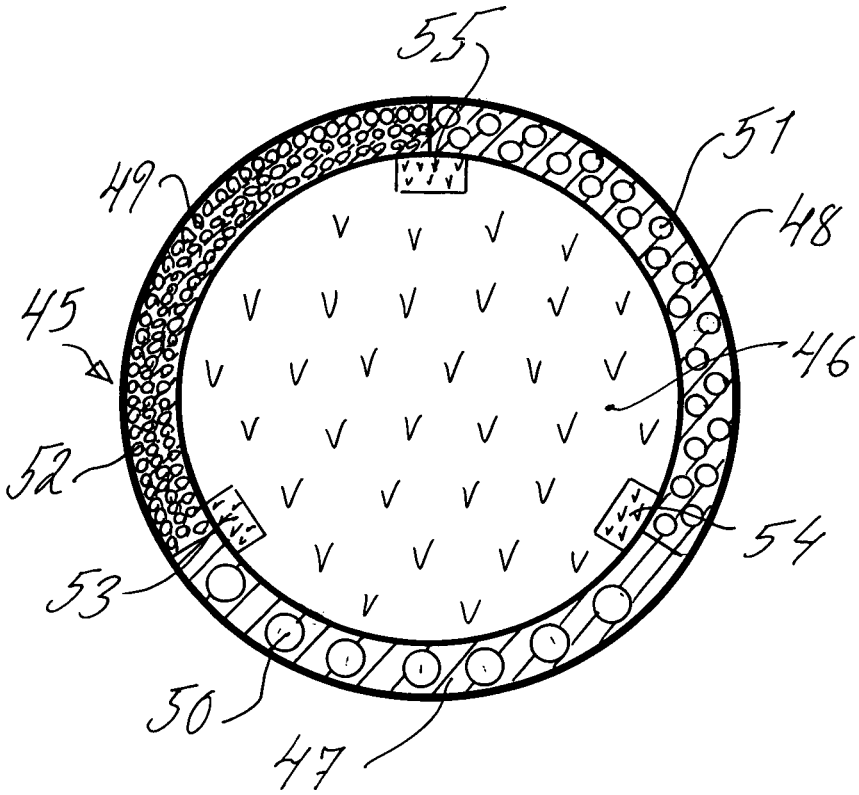
FIG. 11 shows a cross-section projection through an explosive-filled fragmentation charge provided with variously dimensioned fragments located in different sectors.

FIG. 11 shows a cross-section of a fragmentation charge 45 with an inner explosive charge 46 and a fragmentation casing divided up in to three sectors 47-49 where fragmentation casing sector 47 contains a small quantity of extremely large fragmentation bodies 50 intended for use against particularly hard targets while fragmentation casing sector 48 contains many more but slightly smaller fragmentation bodies 51 while finally, fragmentation casing sector 49 contains a very large quantity of small fragmentation bodies 52 intended mainly for combating soft targets. Furthermore there are three different initiation fuzes 53-55 in the charge of which fuze 55 aims initiation of the explosive towards fragmentation casing sector 47 while fuze 53 aims the explosion towards fragmentation casing sector 48 and finally, fuze 54 aims the explosion towards fragmentation casing sector 49. With the fragmentation charge 45 mounted in a roll-stabilised projectile or in a rolling projectile where there is constant monitoring of the roll movement consequently the desired type of fragments with which to combat the target can be selected using fragmentation charges formed in this way.

The invention claimed is:

1. Method of producing fragment-forming casing or parts thereof created by detonation of the explosive charge contained in explosive warheads and of a type that entails sintering powder metal to produce a single-unit moulded part in which heavy metal balls or other individually produced fragmentation bodies are embedded, the moulded part in which the fragmentation bodies are embedded being produced in a two-stage powder compaction procedure followed by sintering of the compacted powder metal, the first powder compaction stage comprising an initial fixation of the location of the fragmentation bodies completely free from contact with each other in a template or fixture, where the fragmentation bodies only have limited contact with the fixture via their own limiting outer surface, after which those parts of the fragmentation bodies that are not in direct contact with the fixture are covered with, and the free space between the fragmentation bodies is filled completely with, powder metal, which is then compacted under high pressure to form a single body having its own material strength that binds the fragmentation bodies within itself and that allows the fixture to be removed, after which other parts of the fragmentation bodies now brought into view that had been obscured by the fixture are covered with a second quantity of powder metal which is compacted using a second pressure stage to form its own single body and unified with the first quantity of powder metal and then sintered by means of hot sintering to form a uniform metal body within which the fragmentation bodies lie distributed in a predefined pattern.

2. The method as claimed in claim 1 wherein a rubber matting insert is used as a pressure equalising medium between the added quantities of powder metal in the first and second powder application stages and the medium or device that generates the compaction pressure, irrespective of whether the pressure is generated mechanically or isostatically.

3. The method as claimed in claim 1 or 2 wherein during the first application and compaction of powder stage, a fixture provided with guide cavities is utilised and in which the location of the fragmentation bodies relative to each other can be fixed initially.

4. The method as claimed in claim 3 wherein the guide cavities in said fixture are connected via special-to-purpose openings to a vacuum pressure with which the fragmentation bodies can be fixed in the respectively provided guide cavities.

5. The method as claimed in claim 3 wherein the fragmentation bodies, prior to and during the first application and compaction of powder stage, are temporarily fixed in their guide cavities or guide locations using glue having an adhesion capability that will still permit the fixture to be removed when said first powder compaction stage has been completed.

6. The method as claimed in claim 1 wherein mainly tubular preformed fragmentation casings are Produced vertically where the fragmentation bodies are retained in their respective guide cavities in said fixture by a glue or constant vacuum pressure applied from the opposite side of the fixture via through-holes located in the guide cavities that are connected to said fragmentation bodies and where said vacuum pressure is maintained constant until the first quantity of powder, using the fixture as resistance, is compressed to form a self-supporting unit with a first elastic deformation layer of material as an intermediate wall against the isostatic compaction pressure established between the fixture and said first layer of material applied to the powder material, after which said first elastic deformation layer of material is replaced by a fixed resistance while the fixture is replaced by a second elastic deformation layer of material located at a distance from the first, now established, layer of powder, after which the space between the first compacted powder layer and said second elastic deformation layer of material is filled with a second addition of powder that is compacted by applying isostatic pressure on the outside surface of said second elastic deformation layer of material, after which the isostatic pressure and said second elastic deformation layer of material are removed when the powder material has compacted to form a single unit and the powder granules have been sintered to form a single unified metal body inside which the fragmentation bodies lie embedded.

7. The method as claimed in claim 6 wherein said first quantity of powder is established between the inside of the fixture and a tubular dividing wall located inside said fixture made of a stiff but deformable material which is subjected to high isostatic pressure after the space between said dividing wall and the fixture has been filled with the relevant powder metal for the purpose of compacting the said powder metal, after which the fixture, when the isostatic pressure has been removed first, is also removed and an outer tubular wall made of a flexible but stiff deformation material is established outside the first layer of powder and the space between them is filled with powder metal that is compacted isostatically, after which the resulting single unit powder body so generated, with its content of fragmentation bodies in the form of heavy metal balls located free from each other, is subjected to a sufficiently high temperature as to sinter together the powder material.

8. The method as claimed in claim 1 wherein preformed fragmentation casings including such casings having very bulged surfaces are produced more or less horizontally in the form of several separate sections of casing comprising only a first quantity of powder containing at least partly embedded fragmentation bodies, after which said sections of casing are arranged together on a fixed resistance device and are joined together by means of a common second compacted quantity of powder preformed in a second pressure stage.

9. A preformed fragmentation casing for use in warhead charges filled with explosive produced in accordance with the method as claimed in claim 1 wherein the exterior form of said fragmentation casing is defined in a two-stage powder metal sintering method that generates a homogenous moulded part in which the fragmentation bodies in the form of heavy metal balls are embedded at a predetermined distance relative to each other and distributed completely free from contact with each other.

10. The preformed fragmentation casing as claimed in claim 9 wherein said casing comprises several separately produced sections of casing joined together by a powder metallurgical method and having the same or different configuration, each in turn including a quantity of powder compacted to form a single unit inside of which separately produced fragmentation bodies are embedded free from contact with each other, said sections of casing being held together by a common layer of sintered powder, metal which in turn is also sintered together with the powder material in the casing section.

11. A device for the purpose of producing preformed fragmentation casing using powder metal technology in accordance with the method defined in claim 1 for use in warhead charges of the type that comprise several separately produced sections of fragmentation casing and are filled with explosive, wherein said sections of preformed fragmentation sections being embedded in a moulded part, said device incorporating a fixture provided with facilities for defining the location of the fragmentation bodies relative to each other until the first quantity of powder metal for the moulded part has been applied and compacted, as well as at least one pressure-equalising intermediate wall arranged between said powder and the compression pressure applied during the compaction of the powder.

* * * * *